US006494589B1

(12) United States Patent
Shyu

(10) Patent No.: US 6,494,589 B1
(45) Date of Patent: Dec. 17, 2002

(54) CEILING FAN HAVING ONE OR MORE CHANGEABLE LAMP DEVICES

(76) Inventor: Shing Jy Shyu, P.O. Box 10-69, Chong Ho, Taipei (TW), 235

( * ) Notice: Subject to any disclaimer, the term of this patent is extended or adjusted under 35 U.S.C. 154(b) by 0 days.

(21) Appl. No.: 09/942,545

(22) Filed: Aug. 31, 2001

(51) Int. Cl.[7] ..... F21V 33/00
(52) U.S. Cl. ..... 362/96; 362/404; 416/5
(58) Field of Search ..... 362/96, 404, 253, 362/457, 147, 226; 416/5

(56) References Cited

U.S. PATENT DOCUMENTS 5,437,540 A * 8/1995 Blocker et al. ..... 362/96
5,568,969 A * 10/1996 Yu ..... 362/404
6,062,816 A * 5/2000 Chang ..... 416/5
6,089,725 A * 7/2000 Chen ..... 362/96
6,322,232 B1 * 11/2001 Oliver ..... 362/147

* cited by examiner

*Primary Examiner*—Thomas M. Sember

(57) ABSTRACT

A ceiling fan includes a control box having a downward extending sleeve bolt, a lamp device having an upward extending sleeve bolt, and a connecting barrel secured between the sleeve bolts for detachably securing the lamp device to the control box. One or more lamp devices may further be selectively secured or assembled onto the ceiling fan for forming various kinds of decorative effects. The lamp device includes a cap and a base plate and a lamp shade and a canopy secured together. The cap and the canopy have the sleeve bolts for coupling to the connecting barrel.

13 Claims, 5 Drawing Sheets

CEILING FAN HAVING ONE OR MORE CHANGEABLE LAMP DEVICES

BACKGROUND OF THE INVENTION

1. Field of the Invention

The present invention relates to a ceiling fan, and more particularly to a ceiling fan having one or more changeable lamp devices.

2. Description of the Prior Art

Typical ceiling fans comprise a control box provided and attached to the bottom portion thereof, and a lamp seat secured or attached to the bottom portion of the control box for receiving or plugging one or more lamp devices or light bulbs. A lamp shade is secured to the lamp seat for covering or shielding the lamp devices. Only the light bulbs may be changed or replaced with the other ones when the light bulbs are damaged. The lamp seat and the lamp shade may not be easily changed to different lamp seats and lamp shades by the users.

The present invention has arisen to mitigate and/or obviate the afore-described disadvantages of the conventional lamp devices for ceiling fans.

SUMMARY OF THE INVENTION

The primary objective of the present invention is to provide a ceiling fan including one or more lamp devices that may be changed with each other or that may be assembled to the ceiling fan simultaneously for changing the decorative effect.

In accordance with one aspect of the invention, there is provided a ceiling fan comprising a control box including a lower portion having an upper sleeve bolt extended downward therefrom, a lamp device including an upper portion having a lower sleeve bolt extended upward therefrom, and a connecting barrel secured between the upper and the lower sleeve bolts for detachably securing the lamp device to the control box of the ceiling fan.

The lamp device includes a base plate having a bottom portion and an upper portion, a cap secured on the upper portion of the base plate and having the upper sleeve bolt secured thereto and extended upward beyond the cap for coupling to the connecting barrel, at least one light member attached to the bottom portion of the base plate, a lamp shade attached to the bottom portion of the base plate for shielding the light member, the lamp shade having a bottom portion, a canopy secured to the bottom portion of the lamp shade and having the lower sleeve bolt extended downward beyond the canopy.

A switch device is further provided and secured between the lamp shade and the canopy, and includes the lower sleeve bolt secured thereto.

A frame is further provided and includes an upper portion secured to the base plate, and includes a lower portion secured to the canopy with the lower sleeve bolt.

The base plate includes a center portion having a recess formed therein, and includes a power device received in the recess thereof and electrically coupled to the light member for controlling the light member.

One or more second lamp devices are further provided and includes an upper portion having a first sleeve bolt extended upward therefrom and coupled to the connecting barrel, and includes a lower portion having a second sleeve bolt extended downward therefrom, and a connecting barrel secured between the second sleeve bolt and the lower sleeve bolt for detachably securing the second lamp device between the control box and the lamp device. The lamp devices may thus be selectively secured or assembled onto the ceiling fan for providing various kinds of decorative effects.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
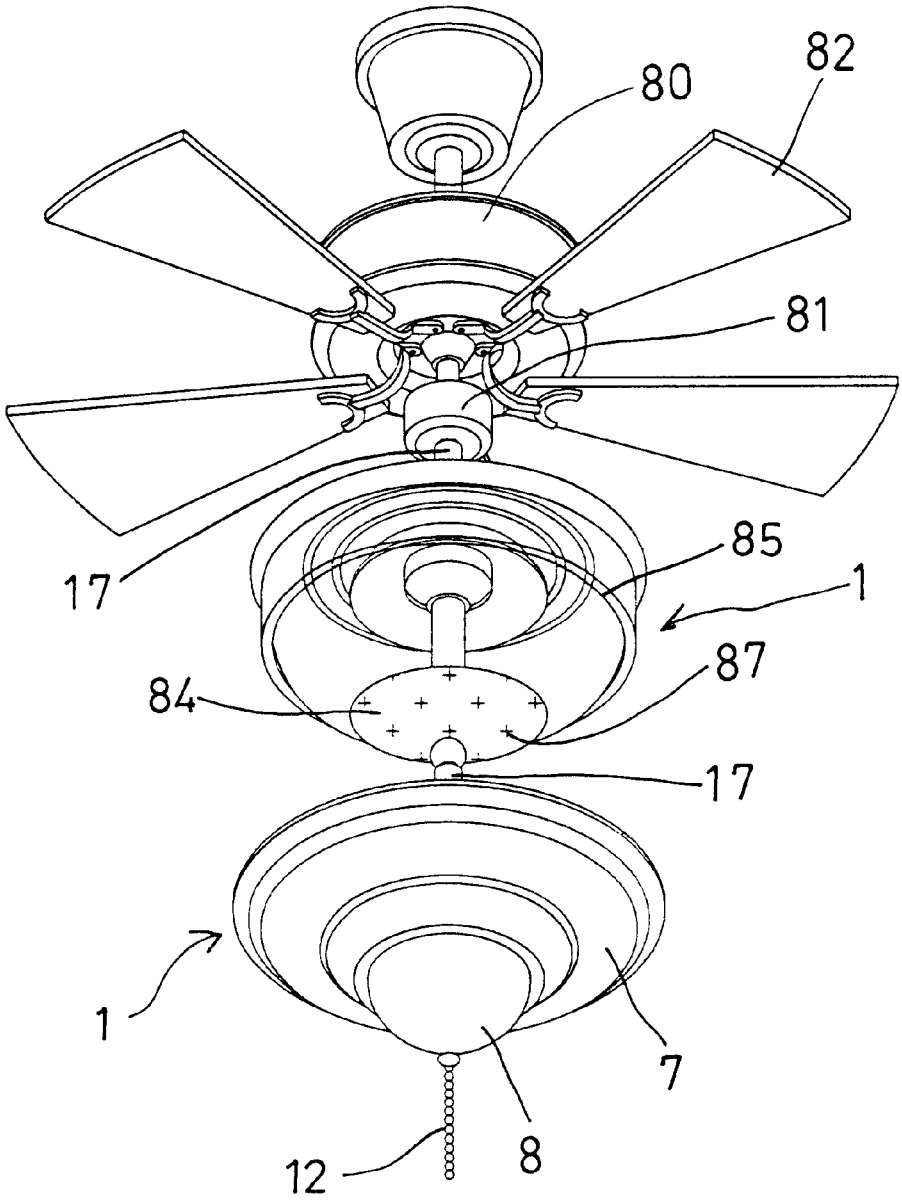
FIG. 1 is a bottom perspective view of a ceiling fan in accordance with the present invention having two lamp devices attached thereto.

Referring to the drawings, and initially to FIGS. 1–5, a ceiling fan 80 in accordance with the present invention comprises a typical control box 81 attached to the bottom portion thereof, and located below the typical fan blades 82, and one or more lamp devices 1 to be attached or assembled onto the bottom of the control box 81. The control box 81 includes a typical electric circuit (not shown) provided therein for controlling the operation of the fan blades 82 and/or the lamp devices 1, and includes a hollow bolt or a through bolt or a connecting sleeve bolt 18 attached to the bottom portion thereof, and extended downward and outward of the bottom portion thereof, for receiving or threading with one or more electric wires 83 therein. A connecting barrel 17 includes an upper portion threaded to the sleeve bolt 18 and includes a lower portion for threading or coupling to the lamp devices 1.

The lamp devices 1 may include different lamp shades 84, 85, 7, 8 for providing different decorative effects. For example, the lamp shades 84 (FIGS. 1, 2) may include different colors, and/or patterns 87 applied thereon. The lamp shades shades 84, 85, 7, 8 may also include different shapes, as shown in the drawings, for providing different decorative effects. The lamp devices 1 each includes a connecting sleeve bolt 11 provided or disposed in the upper portion thereof, and another connecting sleeve bolt 11 provided or disposed in the lower portion thereof. The connecting sleeve bolts 11 may be coupled together with the connecting barrels 17, for allowing the lamp devices 1 to be easily and quickly assembled or coupled together to the ceiling fan 80.

Figure 5:
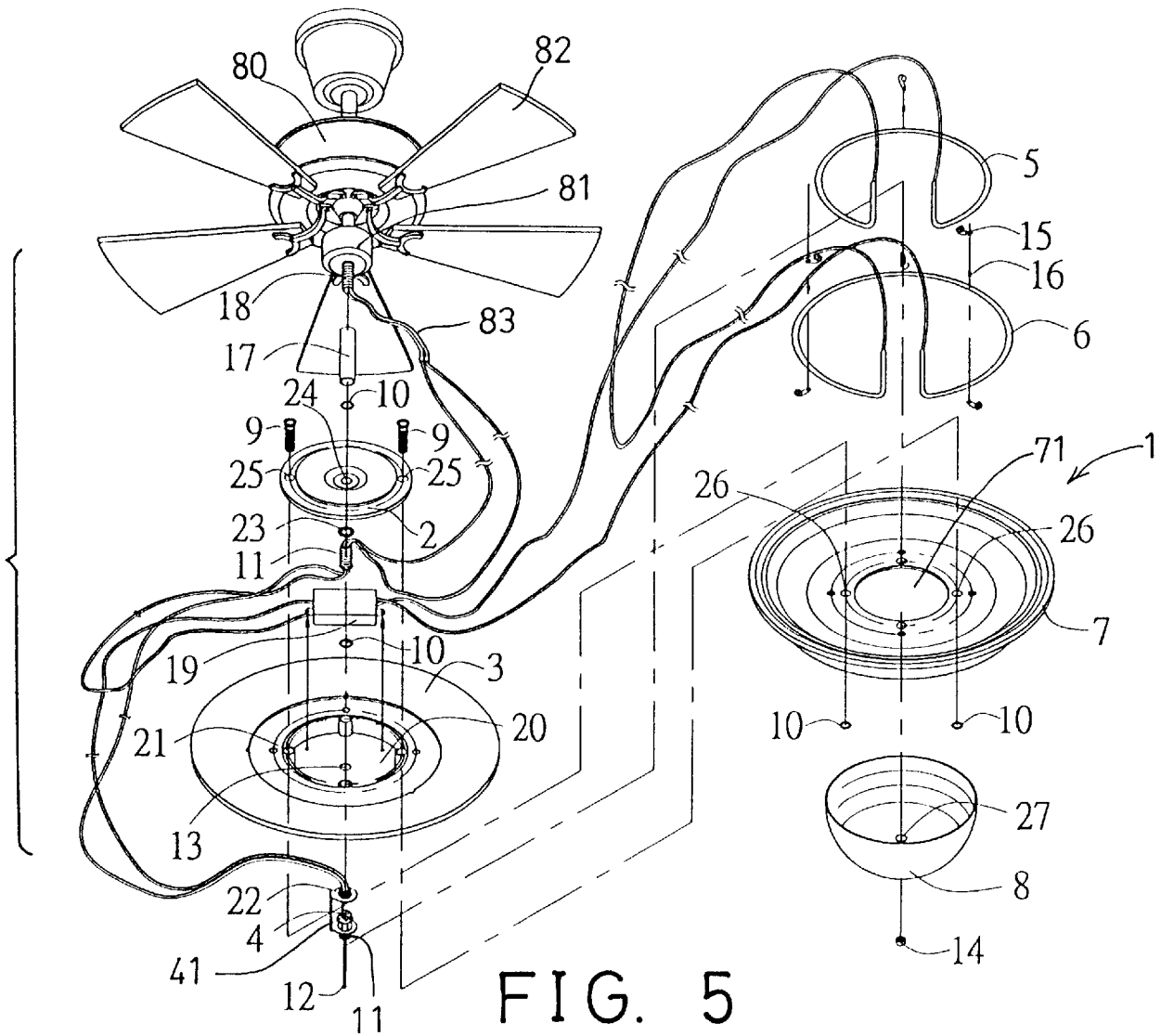
FIG. 5 is an exploded view of the lamp device.
Figure 6:
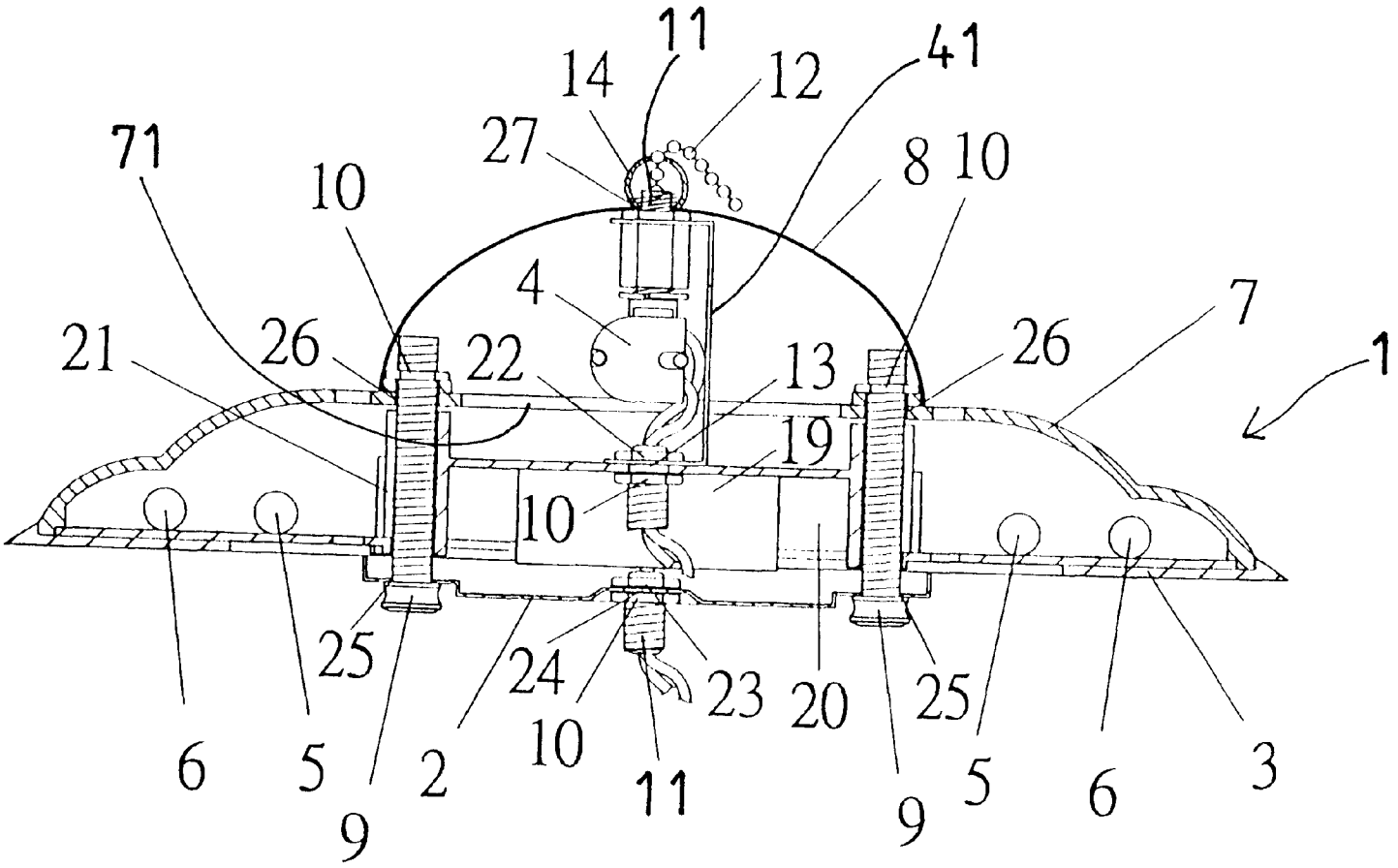
FIG. 6 is a cross sectional view taken along lines 6—6 of FIG. 4, illustrating the inner structure of the lamp device.

Referring next to FIGS. 5 and 6, illustrated is a detailed structure of one of the lamp devices 1. The lamp device 1 includes a base plate 3 having a recess 20 formed in the center portion thereof, and having an orifice 13 formed in the center portion of the recess 20 thereof, and having one or more studs 21 formed or provided around the recess 20 thereof for threading with fasteners 9. A cap 2 is engaged on the middle portion of the base plate 3 and includes one or more holes 25 formed therein for receiving the fasteners 9 which may secure the cap 2 on top of the base plate 3. The cap 2 includes a hole or a screw hole 24 formed in the middle or center portion thereof for threading with another connecting sleeve bolt 11. One or more lock nuts 10, 23 may further be provided and threaded with the sleeve bolt 11 for further solidly securing the sleeve bolt 11 to the cap 2. The sleeve bolt 11 may be threaded to the lower portion of the connecting barrel 17 for easily securing the lamp device 1 to the bottom of the control box 81 of the ceiling fan 80.

One or more light members 5, 6 may be secured to the base plate 3 with one or more hooks 15 and one or more fasteners 16. A power device 19 includes such as one or more batteries therein, or includes a power circuit provided therein and coupled to the light members 5, 6 for controlling or for energizing the light members 5, 6. A lamp shade 7 is engaged on the bottom portion of the base plate 3 and includes one or more holes 25 formed therein for receiving the fasteners 9 which may secure the lamp shade 7 to the bottom of the base plate 3. One or more lock nuts 10 may further be provided and threaded with the fasteners 9 for solidly securing the lamp shade 7 to the base plate 3. The lamp shade 7 includes an opening 71 formed in the middle or center portion thereof.

A switch device 4 is secured in a frame 41, such as secured in the lower portion of the frame 41 with a lower connecting sleeve bolt 11, and includes a pulling chain 12 or the like extended downward and outward through the sleeve bolt 11. The frame 41 is received in or engaged through the opening 71 of the lamp shade and includes an upper portion having a fastener 22 engaged through the orifice 13 of the base plate 3 and secured to the base plate 3 with one or more lock nuts 10. Another lamp shade or a canopy 8 is engaged or attached to the bottom portion of the lamp shade 7 and includes a hole 27 formed in the center portion thereof for receiving the lower sleeve bolt 11. A lock nut 14 or the like may be threaded with the lower sleeve bolt 11 for securing the canopy 8 to the bottom of the lamp shade 7. The lamp device 1 thus includes an upper sleeve bolt 11 and a lower sleeve bolt 11 for coupling to the ceiling fan 80 and/or the other lamp devices 1 with the connecting barrels 17.

Figure 2:
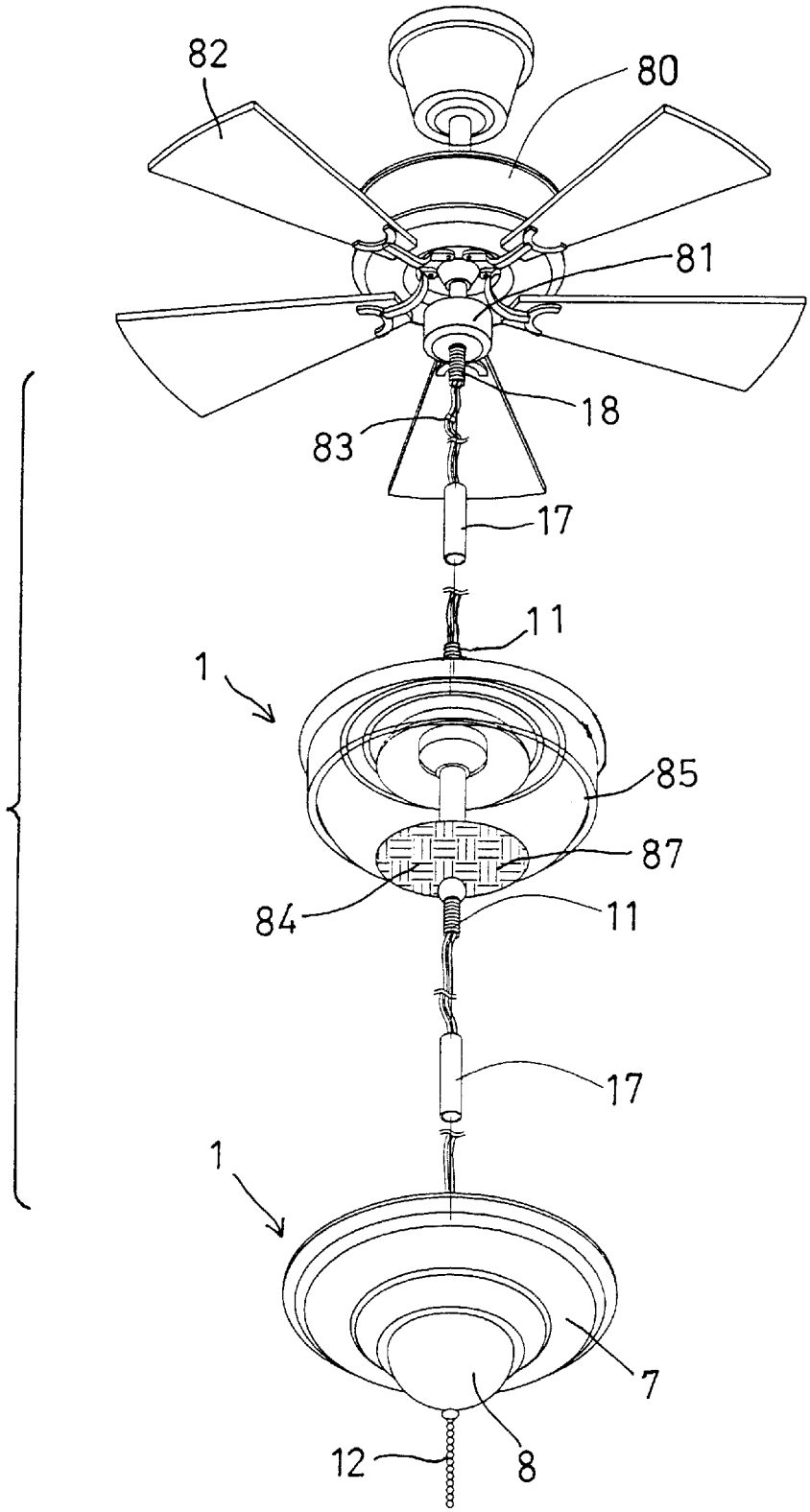
FIG. 2 is a partial exploded view of the ceiling fan and the lamp devices as shown in FIG. 1.
Figure 4:
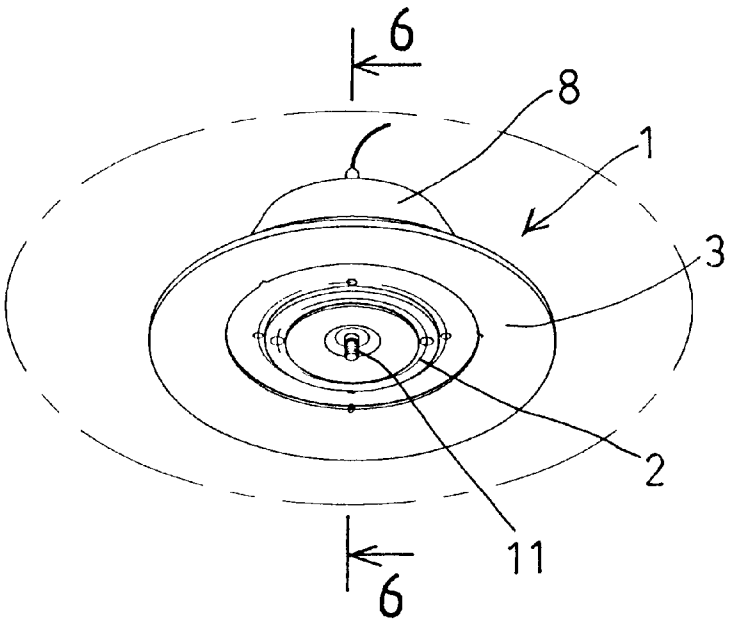
FIG. 4 is a perspective view of the lamp device, in which the lamp device is disposed up-side-down.
Figure 3:
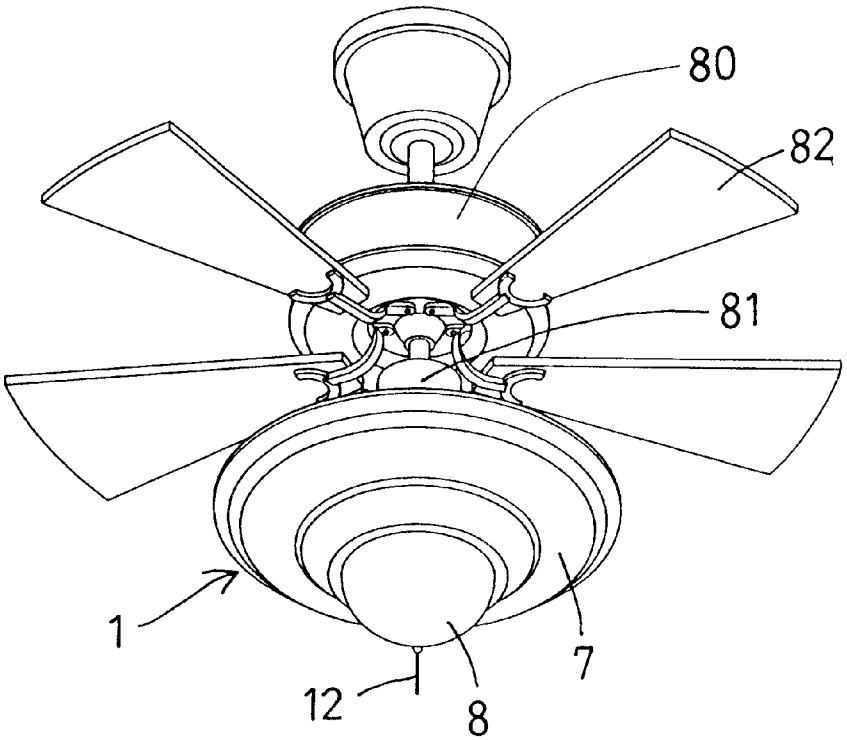
FIG. 3 is a bottom perspective view of the ceiling fan having one lamp device attached thereto.

In operation, as shown in FIGS. 1 and 2, one or more lamp devices I may further be provided and coupled or secured between the ceiling fan 80 and a bottom lamp device 1. Alternatively, as shown in FIG. 3, a single lamp device 1 may also be directly attached to the bottom of the ceiling fan 80. The other lamp devices may be changed with each other or may be changed or alternatively secured to the ceiling fan 80 for changing the decorative effect for the ceiling fan 80.

Accordingly, the ceiling fan in accordance with the present invention includes one or more lamp devices that may be changed with each other or that may be assembled to the ceiling fan simultaneously for changing the decorative effect.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A lamp device for a ceiling fan, said lamp device comprising:

a base plate including a bottom portion, and including an upper portion, a cap secured on said upper portion of said base plate, and including a center portion having an upper sleeve bolt secured thereto and extended upward beyond said cap for coupling to the ceiling fan, at least one light member attached to said bottom portion of said base plate, a lamp shade attached to said bottom portion of said base plate for shielding said at least one light member, said lamp shade including a bottom portion, a canopy secured to said bottom portion of said lamp shade, and a switch device secured between said lamp shade and said canopy, and including a lower sleeve bolt secured to said canopy and extended downward beyond said canopy.

2. The lamp device according to claim 1 further comprising a frame including an upper portion having a fastener secured to said base plate, and including a lower portion secured to said canopy with said lower sleeve bolt.

3. The lamp device according to claim 1 further comprising a connecting barrel including a first end threaded to said upper sleeve bolt and including a second end for securing to the ceiling fan.

4. The lamp device according to claim 1, wherein said base plate includes a center portion having a recess formed therein, and includes a power device received in said recess thereof and electrically coupled to said at least one light member for controlling said at least one light member.

5. A lamp device for a ceiling fan, said lamp device comprising:

a base plate including a center portion having a recess formed therein, and including a bottom portion, and including an upper portion, a cap secured on said upper portion of said base plate, and including a center portion having an upper sleeve bolt secured thereto and extended upward beyond said cap for coupling to the ceiling fan, at least one light member attached to said bottom portion of said base plate, a power device received in said recess of said base plate and electrically coupled to said at least one light member for controlling said at least one light member, a lamp shade attached to said bottom portion of said base plate for shielding said at least one light member, said lamp shade including a bottom portion, a canopy secured to said bottom portion of said lamp shade, and a switch device secured between said lamp shade and said canopy, and including a lower sleeve bolt secured to said canopy and extended downward beyond said canopy.

6. The lamp device according to claim 5 further comprising a frame including an upper portion having a fastener secured to said base plate, and including a lower portion secured to said canopy with said lower sleeve bolt.

7. The lamp device according to claim 5 further comprising a connecting barrel including a first end threaded to said upper sleeve bolt and including a second end for securing to the ceiling fan.

8. A ceiling fan comprising:

a control box including a lower portion having an upper sleeve bolt extended downward therefrom, a lamp device including an upper portion having a lower sleeve bolt extended upward therefrom, and a connecting barrel secured between said upper and said lower sleeve bolts for detachably securing said lamp device to said control box of said ceiling fan.

9. The ceiling fan according to claim 8, wherein said lamp device includes a base plate having a bottom portion and an upper portion, a cap secured on said upper portion of said base plate and having said upper sleeve bolt secured thereto and extended upward beyond said cap for coupling to the connecting barrel, at least one light member attached to said bottom portion of said base plate, a lamp shade attached to said bottom portion of said base plate for shielding said at least one light member, said lamp shade having a bottom portion, a canopy secured to said bottom portion of said lamp shade and having said lower sleeve bolt extended downward beyond said canopy.

10. The ceiling fan according to claim 9 further comprising a switch device secured between said lamp shade and said canopy, and including said lower sleeve bolt secured thereto.

11. The ceiling fan according to claim 10 further comprising a frame including an upper portion secured to said base plate, and including a lower portion secured to said canopy with said lower sleeve bolt.

12. The ceiling fan according to claim 10, wherein said base plate includes a center portion having a recess formed therein, and includes a power device received in said recess thereof and electrically coupled to said at least one light member for controlling said at least one light member.

13. The ceiling fan according to claim 8 further comprising at least one second lamp device including an upper portion having a first sleeve bolt extended upward therefrom and coupled to said connecting barrel, and including a lower portion having a second sleeve bolt extended downward therefrom, and a connecting barrel secured between said second sleeve bolt and said lower sleeve bolt for detachably securing said at least one second lamp device between said control box and said lamp device.

* * * * *